US005371579A

United States Patent [19]

Bisaiji

[11] Patent Number: 5,371,579

[45] Date of Patent: Dec. 6, 1994

[54] PRETRANSFER CHARGING DEVICE FOR IMAGE FORMING EQUIPMENT

[75] Inventor: Takashi Bisaiji, Yokohama, Japan

[73] Assignee: Ricoh Company, Ltd., Tokyo, Japan

[21] Appl. No.: 79,952

[22] Filed: Jun. 3, 1993

Related U.S. Application Data

[63] Continuation of Ser. No. 947,979, Sep. 21, 1992, abandoned, which is a continuation of Ser. No. 750,395, Aug. 27, 1991, abandoned.

[30] Foreign Application Priority Data

Aug. 29, 1990 [JP] Japan ..... 2-229462

[51] Int. Cl.[5] ..... G03G 15/14

[52] U.S. Cl. ..... 355/273; 355/208; 355/246

[58] Field of Search ..... 355/245, 246, 208, 271, 355/273, 274

[56] References Cited

U.S. PATENT DOCUMENTS

| | | | |
|---|---|---|---|
| 4,134,147 | 1/1979 | Watanabe | 355/272 X |
| 4,338,017 | 7/1982 | Nishikawa | 355/274 X |
| 4,395,112 | 7/1983 | Miyakawa et al. | 355/246 |
| 4,912,515 | 3/1990 | Amemiya et al. | 355/274 |
| 4,965,637 | 10/1990 | Katoh et al. | 355/246 |
| 5,170,210 | 12/1992 | Saruwatari | 355/208 |

*Primary Examiner*—Michael L. Gellner
*Assistant Examiner*—Patrick J. Stanzione
*Attorney, Agent, or Firm*—Oblon, Spivak, McClelland, Maier, & Neustadt

[57] ABSTRACT

A pretransfer charging device for image forming equipment controls the output of a pretransfer charger thereof in response to an environment sensor or a sensor responsive to the amount of toner deposited on a reference toner image which is formed on an image carrier. The device allows a desired amount of charge to be deposited on a toner during image transfer.

10 Claims, 7 Drawing Sheets

| HUMIDTY (%RH) | DC BIAS (V) |
|---|---|
| LESS THAN 20 | − 3 0 0 |
| 20 ~ 40 | − 1 5 0 |
| 40 ~ 60 | 0 |
| 60 ~ 80 | 1 5 0 |
| MORE THAN 80 | 3 0 0 |

| TONER DEPOSITION(mg/cm²) | DC BIAS (V) |
|---|---|
| LESS THAN 0.3 | −200 |
| 0.3 ~ 0.5 | 0 |
| MORE THAN 0.5 | +200 |

PRETRANSFER CHARGING DEVICE FOR IMAGE FORMING EQUIPMENT

This application is a continuation of application Ser. No. 07/947,979 filed on Sep. 21, 1992, now abandoned, which was a continuation of application Ser. No. 07/750,395, filed on Aug. 27, 1991 now abandoned.

BACKGROUND OF THE INVENTION

The present invention relates to a pretransfer charging device for an electrophotographic or electrostatic copier, facsimile transceiver, printer or similar image forming equipment.

Predominant type of electrophotographic image forming equipment, for example, applies a charge or a bias voltage to an image transferring medium so as to electrostatically transfer a toner from an image carrier to the transferring medium. In this kind of image transfer system, the amount of charge deposited on the toner contributes a great deal to the image transferring ability since the toner is driven by an electric field developed between the image carrier and the transferring medium. When the amount of charge deposited on the toner is greater or smaller than desired for optimal for image transfer, the following drawbacks (1) and (2) are brought about.

(1) When the actual amount of charge is greater than the desired one, the electrostatic force acting between the toner and the image carrier increases to obstruct the transfer of the toner from the image carrier to the transferring medium despite the electric field.

(2) When the actual amount of charge is smaller than the desired one, the above-mentioned electrostatic force decreases to cause the toner to be transferred even by a weak electric field. Specifically, even when the transferring medium is not held in sufficient contact with the image carrier, the toner is transferred from the image carrier toward the transferring medium. This degrades the quality of a reproduction due to the scattering of toner. Moreover, the inside of a character or similar line image and the edge of a solid image having a substantial area are often lost on a reproduction when the amount of charge is small, although why this occurs has not been accounted for yet.

In light of this, it is a common practice to use a pretransfer charger which deposits a charge on the toner image formed on the image carrier before the transfer, so that an optimal charge for image transfer may be deposited on the toner to be transferred. The pretransfer charger is an extremely effective implementation against the above-described drawbacks since the amount of charge to be deposited on the toner can be controlled by a charge fed from the outside.

However, experiments have showed that when the output of the pretransfer charger is constant, the amount of charge to be deposited on the toner cannot be controlled to a constant value. Specifically, when use is made of a certain kind of developer, the charging characteristic of the developer noticeably changes due to the ambient conditions or aging to in turn change the amount of charge deposited on the toner.

SUMMARY OF THE INVENTION

It is, therefore, an object of the present invention to provide a pretransfer charging device for image forming equipment which allows a desired amount of charge to be deposited on a toner during image transfer.

It is another object of the present invention to provide a generally improved pretransfer charging device.

In accordance with the present invention, a pretransfer charging device incorporated in image forming equipment for depositing a charge on a toner image formed on an image carrier before the transfer of the toner image comprises a pretransfer charger for depositing a charge on the toner image, an environment sensor for sensing an ambient condition, and a controller for controlling the output of the pretransfer charger in response to the output of the environment sensor.

Also, in accordance with the present invention, a pretransfer charging device incorporated in image forming equipment for depositing a charge on a toner image formed on an image carrier before the transfer of the toner image comprises a pretransfer charger for depositing a charge on the toner image, a sensor for sensing the amount of toner deposited on a reference toner image formed on the image carrier, and a controller for controlling the output of the pretransfer charger in response to the output of the sensor means.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 2:
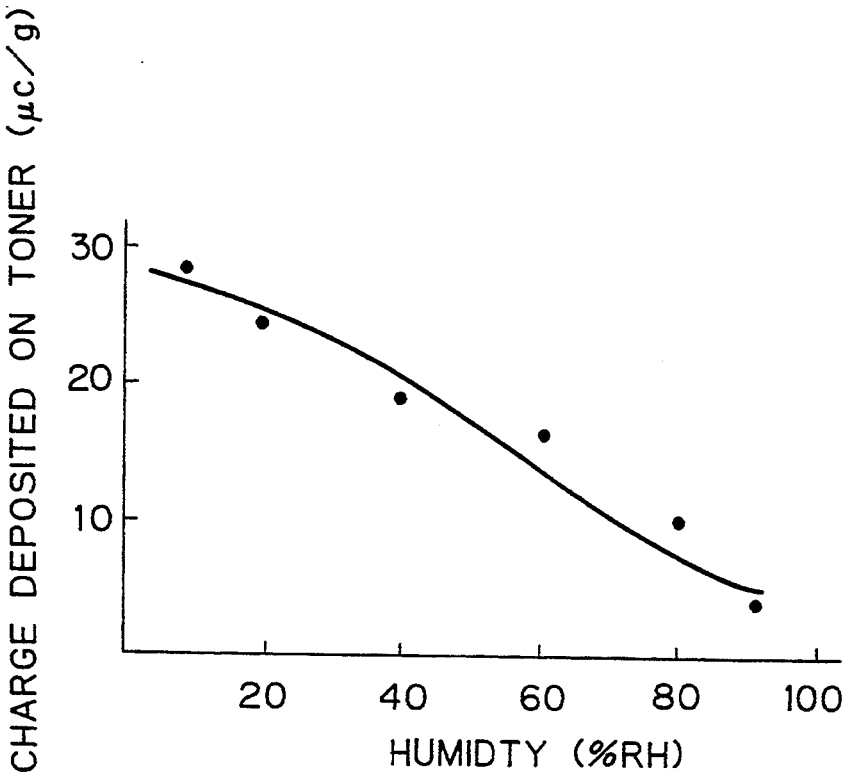
FIG. 2 is a graph indicative of a relation between humidity and the mean amount of charge deposited on a toner.
Figure 3:
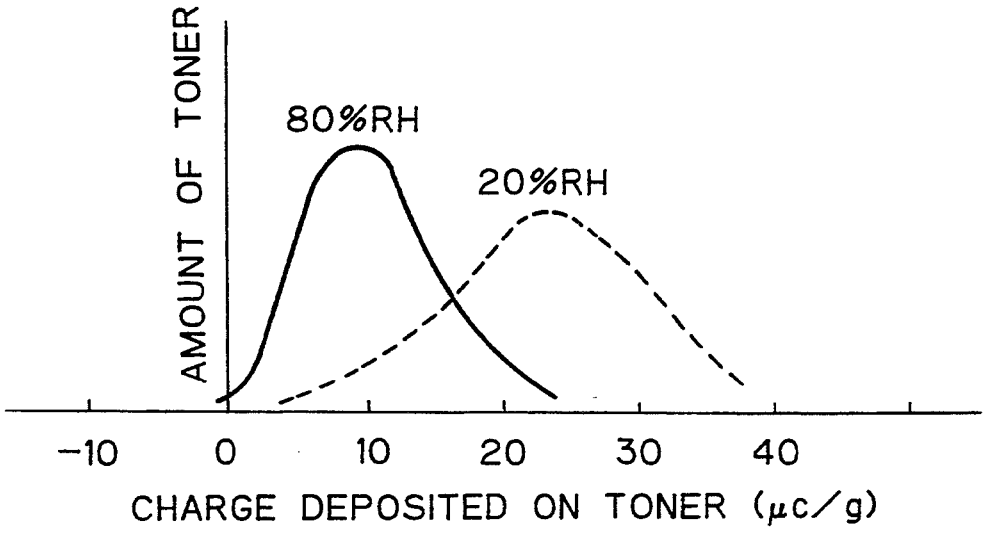
FIG. 3 is a graph showing the distributions of the amount of charge on a toner by using humidity as a parameter.

It was found by experiments that a developer with silica or similar additive which enhances the fluidity of the developer causes the amount of charge deposited on a toner to noticeably change due to changes in ambient conditions, especially humidity. This is shown in FIG. 2 in which the abscissa and the ordinate indicate respectively the humidity and the mean value of the charge distribution on a toner (referred to as a mean charge on a toner hereinafter). Regarding the charge distribution on a toner, it lies in a lower range when humidity is high (80%) than when it is low (20%), as shown in FIG. 3. Hence, the amount of charge to be deposited on a toner during development depends on humidity. The relation between humidity and the amount of charge on a toner is substantially unconditionally determined by the kind of the toner if the amount of silica or similar additive is determined. It follows that the amount of charge on a toner can be known if humidity is detected.

On the other hand, the amount of charge on a toner having been charged by a pretransfer charger (referred to as an output amount of charge) is substantially unconditionally determined by the output of the pretransfer charger and the amount of charge deposited on the toner before the operation of the pretransfer charger (referred to as an input amount of charge hreinafter). In light of this, a relation between humidity and the amount of charge on a toner and the relation between the input amount of charge and the output of the pretransfer charger which implements a desired output amount of charge are determined by experiments beforehand. In response to the output of an environment sensor responsive to humidity and/or temperature, the output of the pretransfer charger is so controlled as to set up the desired output amount of charge.

Figure 7:
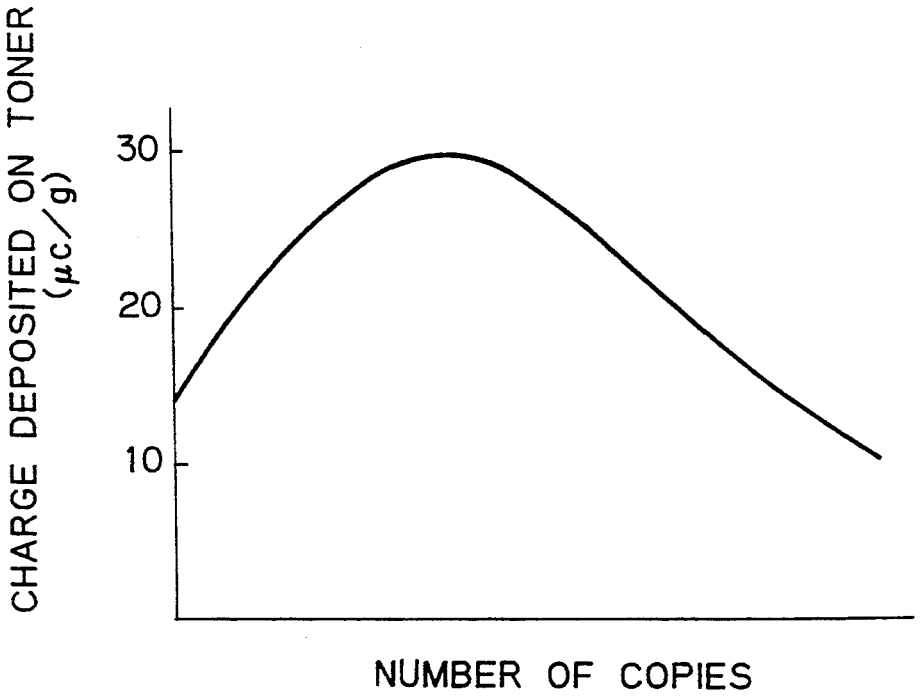
FIG. 7 is a graph showing a relation between the number of copies and the mean amount of charge on a toner.

With a certain kind of two-component developer, the amount of charge on a toner changes due to aging even if humidity is constant, as shown in FIG. 7. In FIG. 7, the abscissa and the ordinate indicate the number of copies produced and the mean amount of charge, respectively. Presumably, such a change is ascribable to the occurrence that the ability to charge a toner changes due to aging since, for example, the carrier particles are sequentially spent by the toner. Development is the electostatic transfer of a charged toner deposited on carrier particles to a latent image electrostatically formed on an image carrier caused by an electric field which is formed in a developing region. Hence, the amount of toner deposition on the image carrier is effected by the intensity of the electric field (difference between the potential of the latent image and the developing bias applied by a developing device). In addition, the amount of toner deposition is susceptible to the amount of charge on the toner. This is because a toner with a small amount of charge is readily transferred from the carrier particles to the latent image due to the weak electrostatic adhesion of the toner to the carrier, while a toner with a great amount of charge is not done so due to the strong electrostatic adhesion to the carrier.

It is, therefore, possible to know the amount of charge on a toner if the amount of toner deposition (amount of development) on a reference toner image formed by developing a latent image on an image carrier is detected.

On the other hand, the output amount of charge to be deposited by the pretransfer charger is substantially unconditionally determined by the output of the pretransfer charger and the input amount of charge. In light of this, a relation between the amount of toner deposition by the known electric field and the amount of charge on a toner and a relation between the input amount of charge and the output amount of charge are determined by experiments beforehand. The amount of toner deposition caused by the known electric field is detected and, based on the detected amount of toner deposition, the output of the pretransfer charger is so controlled as to deposit a desired amount of charge on a toner.

Referring to FIGS. 1 through 6, a pretransfer charging device embodying the present invention is shown and incorporated in an electrophotographic copier by way of example. As shown, the copier has a glass platen 1 on which a document, not shown, is laid. Optics, not shown, is moved along the glass platen 1 while scanning the document with illuminating means thereof. A reflection from the document is focused onto a photoconductive element in the form of a drum 3 which has been uniformly charged by a main charger 2. As a result, a latent image is electrostatically formed on the surface of the drum 3. A developing device 4 is located at the right-hand side of the drum 3 as viewed in FIG. 1 and develops the latent image by a two-component developer to produce a corresponding toner image. A pretransfer charging device, generally 5, has a pretransfer charger 51 and charges the toner image formed on the drum 3. The toner image charged by the pretransfer charger 51 is transferred to a recording medium by a transfer charger 6. The recording medium, or sheet, carrying the toner image thereon is separated from the drum 3 by a separation charger 7 and then routed through a fixing device, not shown, to the outside of the copier as a copy. A cleaning device 8 is located at the left-hand side of the drum 3 as viewed in FIG. 1 and removes the toner remaining on the drum 3 after the image transfer. A discharge lamp 9 dissipates the charge remaining on the drum 3. Then, the drum 3 is ready to be charged again by the main charger 2.

Figures 4, 5:
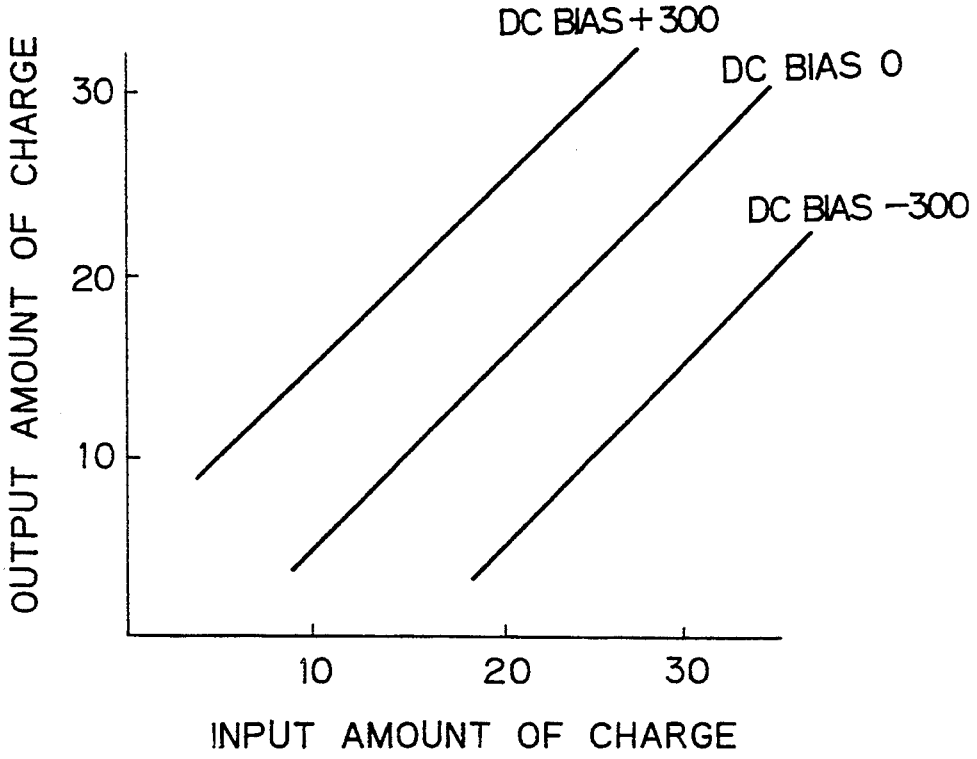
FIG. 4 is a graph representative of the characteristic of a pretransfer charger.
FIG. 5 is a table listing specific humidities and specific control DC biases which correspond to each other.

The pretransfer charging device 5 has, in addition to the pretransfer charger 51, a power source 52, an environment sensor implemented as a humidity sensor 53, and control means in the form of a microcomputer 54. The pretransfer charger 51 outputs AC with a DC bias superposed thereon. Regarding the AC characteristics, the DC-superposed AC output is a rectangular wave having a frequency of 500 Hz, an amplitude of 5.5 kV, and a duty of 50%. FIG. 4 shows a relation between the input and output amounts of charge associated with the charger 51 by using the DC bias of the charger 51 as a parameter.

The relation between humidity and the amount of charge shown in FIG. 2 holds with a toner applicable to the illustrative embodiment. It follows that a DC bias for setting up a desired output amount of charge can be determined if the amount of charge shown in FIG. 2 is used as the input amount of charge. Although FIG. 4 shows only three different cases wherein the DC bias is +300 volts, zero volts, and −300 volts, the relation is also determined with other specific cases by experiments beforehand. FIG. 5 is a table listing DC biases which set up desired output amounts of charge each being associated with a particular humidity.

Figure 1:
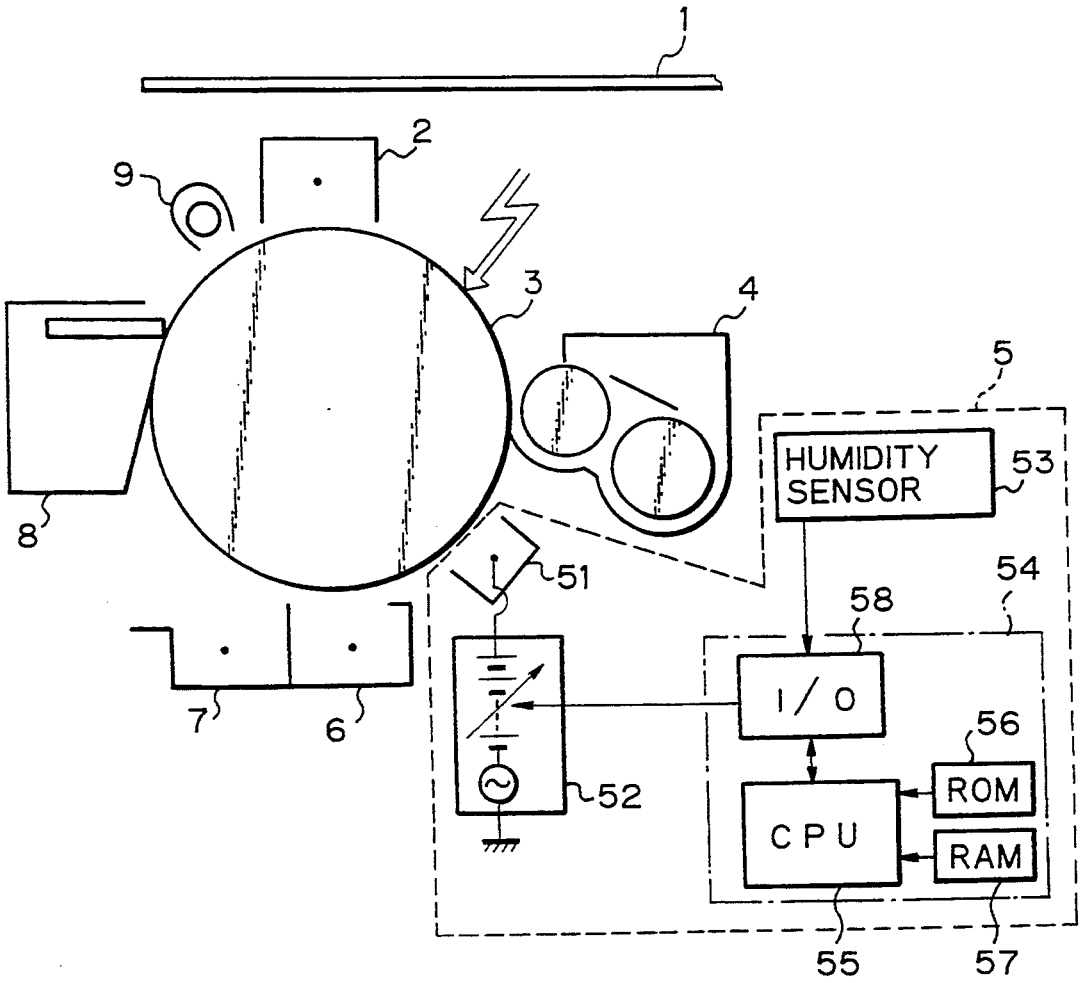
FIG. 1 shows image forming equipment in the form of a copier and incorporating a pretransfer charging device embodying the present invention.

In the illustrative embodiment, the humidity sensor 53 senses humidity, and the microcomputer 54 controls the output of the pretransfer charger 51 in response to the output of the sensor 53 and by using the table shown in FIG. 5. As shown in FIG. 1, the microcomputer 54 mainly consists of a microprocessor (CPU) 55, a ROM (Read Only Memory) 56, a RAM (Random Access Memory), and an interface (I/O) 58. The interface 58 receives at digital signal representative of the output of the humidity sensor 53 and feeds a DC bias signal to the power source 52 via a digital-to-analog (DA) converter, not shown. The ROM 56 stores a data table listing the relation of FIG. 5. The RAM 57 stores a program for controlling the output of the transfer charger 51, as will be described.

Figure 6:
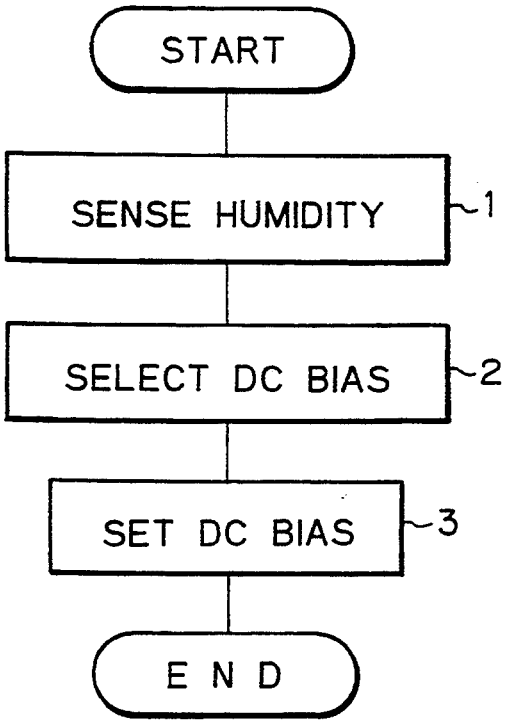
FIG. 6 is a flowchart demonstrating a specific operation of the embodiment.

A reference will be made to FIG. 6 for describing the output control over the pretransfer charger 51. As shown, the microprocessor 55 reads a humidity signal from the interface 58 (step 1) and then looks up the data table of the ROM 56 on the basis of the humidity signal so as to read associated DC bias data (step 2). The microprocessor 55 stores the particular DC bias data in a register and, at the time for driving the pretransfer charger 51, sets the data on the output port of the interface 58 (step 3). As a result, the power source 52 is driven to produce an output matching the DC bias data.

While the embodiment uses a two-component developer, the present invention is also practicable with a single-component developer which lacks carrier particles, so long as the amount of charge on a toner changes with humidity.

Referring to FIGS. 7 through 12, an alternative embodiment of the present invention is shown which detects the amount of toner deposition on the photoconductive drum 3 caused by a known electric field and controls the output of the pretransfer charger 51 on the basis of the detected amount of toner deposition. While the previous embodiment detects humidity to see the input amount of charge, this embodiment detects the amount of toner deposition caused by a known electric field for the same purpose. This embodiment, therefore, uses a data table which is different from that of the previous embodiment in determining the output of the pretransfer charger 51. Use is made of a two-component developer of the kind causing the amount of charge on a toner thereof to change due to aging, as shown in FIG. 7.

Figure 8:
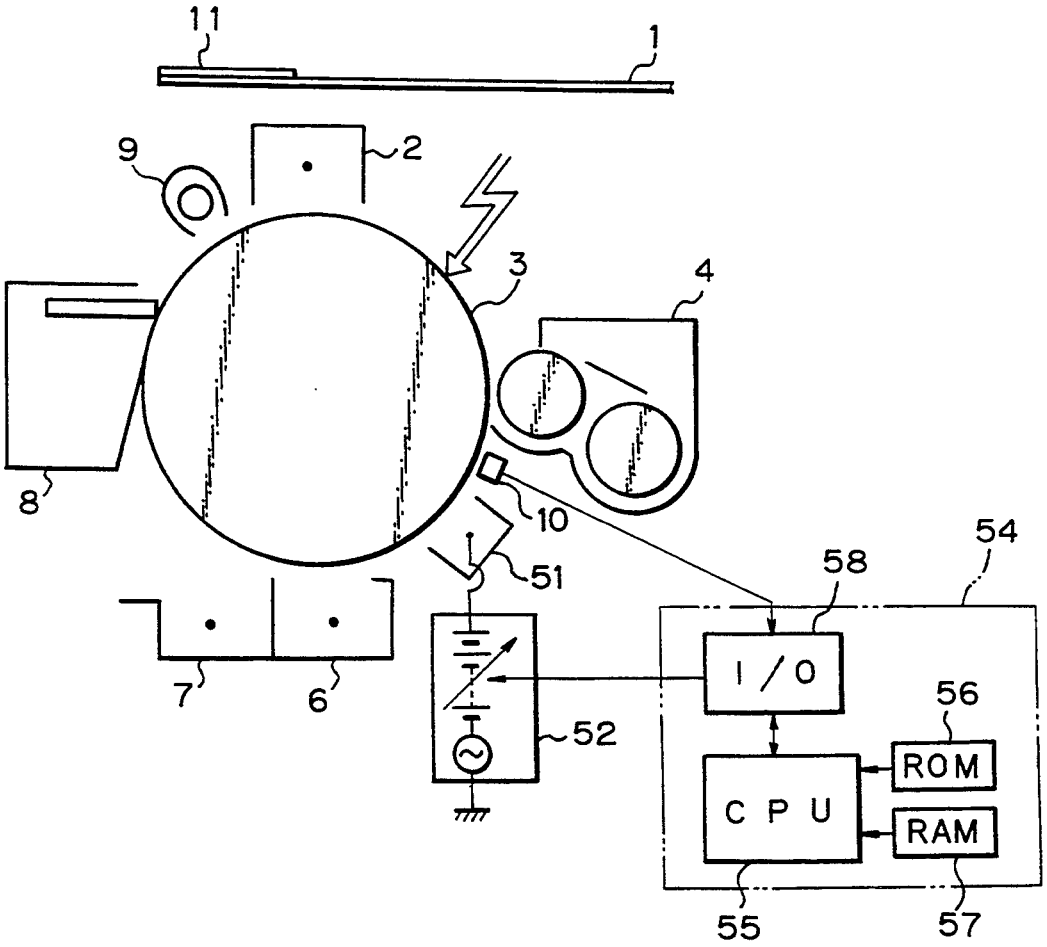
FIG. 8 shows a copier incorporating an alternative embodiment of the present invention.
Figure 9:
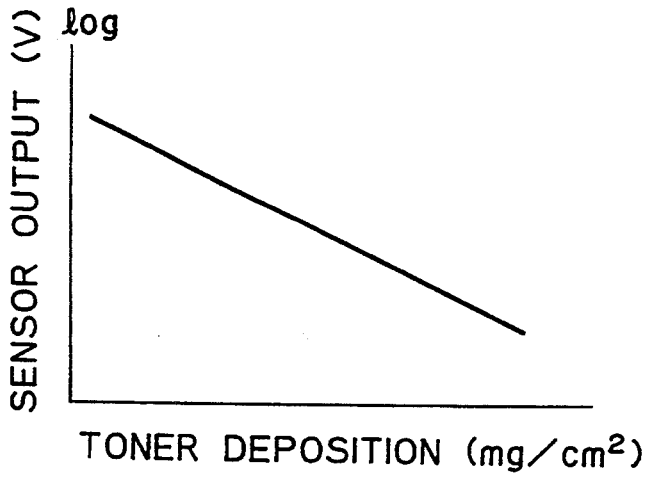
FIG. 9 is a graph showing the input and output characteristic of a photosensor.

FIG. 8 shows the alternative embodiment which is also incorporated in an electrophotographic copier. In FIG. 8, the same or similar components to the components shown in FIG. 1 are designated by like reference numerals, and redundant description will be avoided for simplicity. As shown, a reference density plate 11 having a predetermined density is provided on one side edge of the glass platen 1 in order to develop a known electric field. A latent image representative of the reference density pattern 11 is electrostatically formed on the drum 3 by the optics in an area outside a document image area. The developing device 4 using a known developing bias develops such a latent image to form a reference toner image. A photosensor 10 senses the amount of toner deposition of the reference toner image. The reference toner image whose toner deposition has been so sensed by the photosensor 10 is removed from the drum 3 by the cleaning device 8 without being transferred to a sheet. The photosensor 10 has a specific characteristic shown in FIG. 9 in which the abscissa and the ordinate indicate the amount of toner deposition and the sensor output, respectively.

Figure 10:
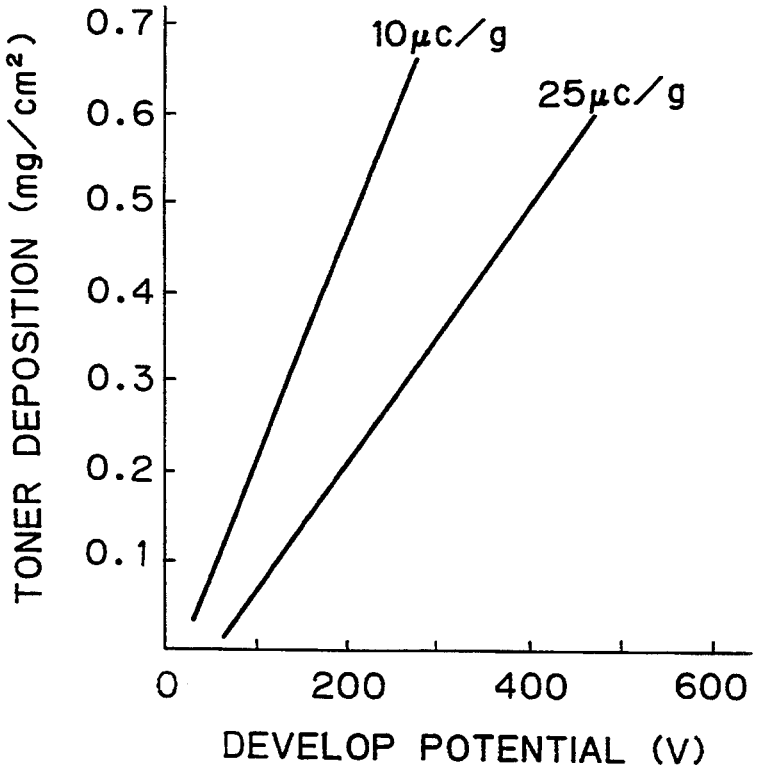
FIG. 10 is a graph showing a relation between the developing potential and the amount of toner deposition.

FIG. 10 shows a relation between the developing potential (difference between the potential of a latent image, i.e., the intensity of an electric field and the developing bias potential) and the amount of toner deposition particular to the alternative embodiment by using the amount of charge on the toner as a parameter. In FIG. 10, the abscissa and the ordinate indicate the developing potential and the amount of toner deposition, respectively.

Figures 11, 12:
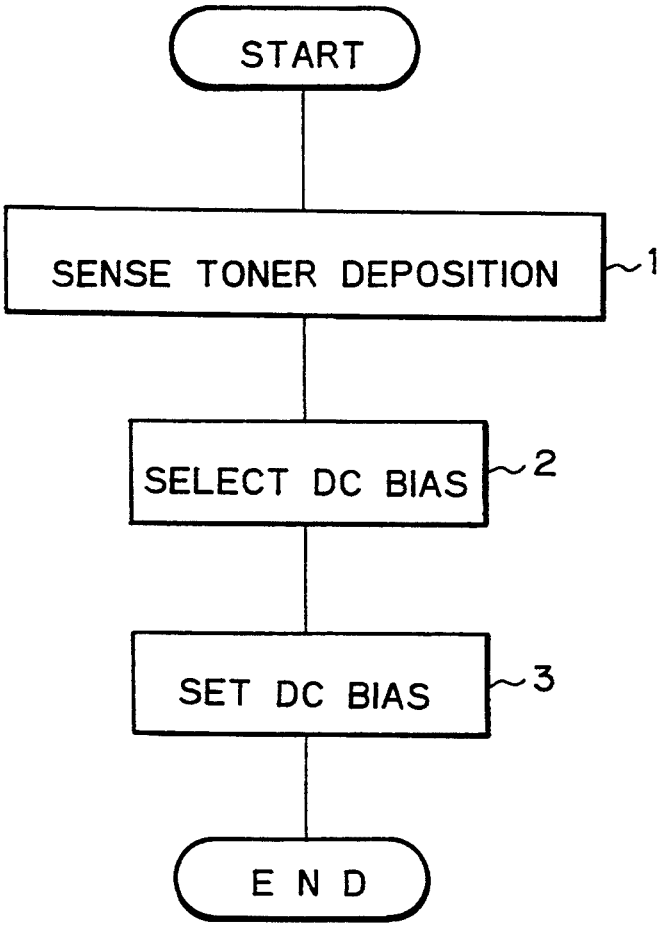
FIG. 11 is a table listing specific amounts of toner deposition and specific control DC biases which correspond to each other.
FIG. 12 is a flowchart demonstrating a specific operation of the alternative embodiment.

The pretransfer charger 51 has the relation between the input amount of charge and the output amount of charge shown in FIG. 4, as stated earlier. In this embodiment, the amount of toner deposition is detected on the basis of the output of the photosensor 10 associated with the reference toner image and by use of FIG. 9. The detected amount of toner deposition is substituted for the amount of toner deposition shown in FIG. 10. Then, an amount of charge on the toner is determined based on the amount of toner deposition of interest and the known developing potential (difference between the latent image potential representative of the reference density plate and the developing bias). Although FIG. 10 shows only two different cases wherein the amount of charge is 10 $\mu$C/g and 25 $\mu$C/g, the relation is also determined with other specific cases by experiments. The amount of charge determined as stated above is used as an input amount of charge, FIG. 4, to thereby determine a DC bias matching a desired output amount of charge. FIG. 11 is a table listing DC biases for setting up desired amounts of charge and each being associated with a particular amount of toner deposition so determined.

This embodiment detects the amount of toner deposition of the reference toner image on the basis of the output of the photosensor 10 and causes the microcomputer 54 to control the output of the pretransfer charger 51 by using FIG. 11. The ROM 56 stores the relation shown in FIG. 11 as a data table while the RAM 57 stores a program for controlling the output of the pretransfer charger 51, as will be described.

FIG. 12 shows the output control over the pretransfer charger 51 specifically. As shown, the microprocessor 55 reads the amount of toner deposition of the reference toner image from the interface 58 (step 1) and then looks up the data table of the ROM 56 on the basis of the amount of toner deposition so as to read associated DC bias data (step 2). The microprocessor 55 stores the particular DC bias data in a register and sets it on the output port of the interface 58 at the time for driving the pretransfer charger 51. As a result, the power source 52 is driven to produce an output matching the DC bias data.

Again, the present invention is practicable even with a single-component developer so long as the amount of charge on a toner thereof changes due to aging.

While the embodiments shown and described each use a data table, they may determine the DC bias for the pretransfer charger 51 by performing arithmetic operations with detected information. Further, the pretransfer charger 51 operable with a DC-superposed AC voltage may be replaced with a charger operable only with a DC voltage or a scorotron type charger having a grid.

In summary, it will be seen that the present invention provides a pretransfer charging device which controls the output of a pretransfer charger thereof in response to the output of an environment sensor or a sensor responsive to the amount of toner deposited on a reference toner image, thereby allowing a desired amount of charge to be deposited on a toner during image transfer.

Various modifications will become possible for those skilled in the art after receiving the teachings of the present disclosure without departing from the scope thereof.

What is claimed is:

1. A pretransfer charging device incorporated in image forming equipment for depositing a charge on toner particles of a toner image formed on an image carrier before the transfer of said toner image, comprising:

a pretransfer charger for depositing a charge on the toner particles of the toner image;

a humidity sensor means for sensing an ambient atmospheric humidity condition; and control means for controlling the output of said pretransfer charger in response to the output of said humidity sensor to allow a desired amount of charge to be deposited on the toner particles of the toner image during image transfer.

2. The device as claimed in claim 1, wherein said control means comprises a read only memory for storing a table correlating the output of said pretransfer charger based on a detected ambient atmospheric humidity condition.

3. A pretransfer charging device incorporated in image forming equipment for depositing a charge on toner particles of a toner image formed on an image carrier before the transfer of said toner image, comprising:

a pretransfer charger for depositing a charge on the toner particles of the toner image;

sensor means for sensing the amount of toner particles deposited on a reference toner image formed on the image carrier;

calculating means for calculating an amount of charge on the toner particles based on the sensed amount of toner deposited on the reference toner image; and control means for controlling the output of said pretransfer charger in response to the output of said sensor means and calculating means.

4. A device as claimed in claim 3, wherein said sensor means comprises a photosensor.

5. The device as claimed in claim 3, wherein said control means comprises a read only memory for storing a table correlating the output of said pretransfer charger based on a detected amount of charge on the toner particles.

6. A pretransfer charging device incorporated in image forming equipment in which charged toner particles are deposited on a latent image formed on an image carrier to form a toner image, the pretransfer charging device depositing a charge on the toner particles of the toner image formed on the image carrier before the transfer of said toner image, comprising:

a pretransfer charger for depositing a charge on the toner particles of the toner image;

a sensor for sensing an atmospheric environmental value associated with the amount of charge of the toner particles; and correcting means for correcting the output of the pretransfer charger in response to a change in the amount of charge of the toner particles represented by the atmospheric environmental value sensed by the sensor.

7. A device as claimed in claim 6, further comprising storing means for storing correction amounts of the output of the pretransfer charger which matches changes in the amount of charge of the toner particles.

8. A pretransfer charging device incorporated in image forming equipment for depositing a charge on toner particles of a toner image formed on an image carrier before the transfer of said toner image, comprising:

a pretransfer charger for depositing a charge on the toner particles of the toner image;

sensor means for sensing the amount of toner particles deposited on a reference toner image formed on the image carrier;

deriving means for deriving an amount of charge on the toner particles from the sensed amount of toner particles deposited on the reference toner image; and control means for controlling the output of said pretransfer charger in response to the output of said deriving means.

9. The device as claimed in claim 8, wherein said deriving means comprises a read only memory for storing a table correlating the output of said pretransfer charger based on a detected amount of charge on the toner particles.

10. The device as claimed in claim 8, wherein said deriving means comprises a calculator for calculating an amount of charge on the toner particles from the sensed amount of toner particles deposited on the reference toner image.

* * * * *